United States Patent [19]

Jardine

[11] 3,966,077

[45] June 29, 1976

[54] PRODUCTION OIL CAN AND TOOL

[76] Inventor: George W. Jardine, 12 Lake Road, Waltham, Mass. 02154

[22] Filed: May 5, 1975

[21] Appl. No.: 574,678

[52] U.S. Cl. ..... 220/70; 220/72; 220/85 R

[51] Int. Cl.[2] ..... B65D 7/42

[58] Field of Search ..... 220/69, 70, 85 R; 75/166 D

[56] References Cited

UNITED STATES PATENTS

| | | | |
|---|---|---|---|
| 85,806 | 1/1869 | Enos | 75/166 D |
| 610,285 | 9/1898 | Scoles | 220/70 |
| 1,300,867 | 4/1919 | Pick | 220/70 |
| 2,217,514 | 10/1940 | Henry | 220/69 |
| 2,551,116 | 5/1951 | Goffart | 75/166 D |
| 2,641,382 | 6/1953 | Mason | 220/69 |
| 3,471,114 | 10/1969 | Ball | 220/69 |

FOREIGN PATENTS OR APPLICATIONS

| | | | |
|---|---|---|---|
| 76,162 | 1929 | Norway | 220/69 |
| 930,321 | 7/1963 | United Kingdom | 220/70 |

*Primary Examiner*—William Price
*Assistant Examiner*—Joseph M. Moy
*Attorney, Agent, or Firm*—James J. Cannon, Jr.

[57] ABSTRACT

A production oil can for use in machine shops having a weighted base, flared rim and height proportionate to the size of brush used to oil machinery. A tool attachment for a drill press having an operative nylon member for stretching and deforming the base of tin cans to provide cavity space for weights in said base.

1 Claim, 5 Drawing Figures

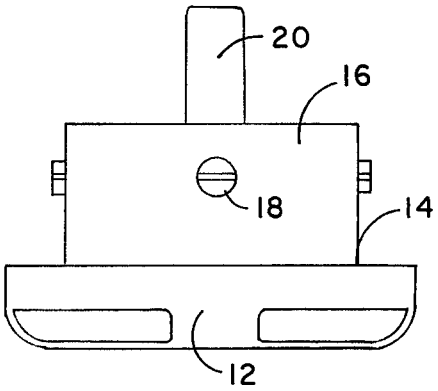
FIG. 1
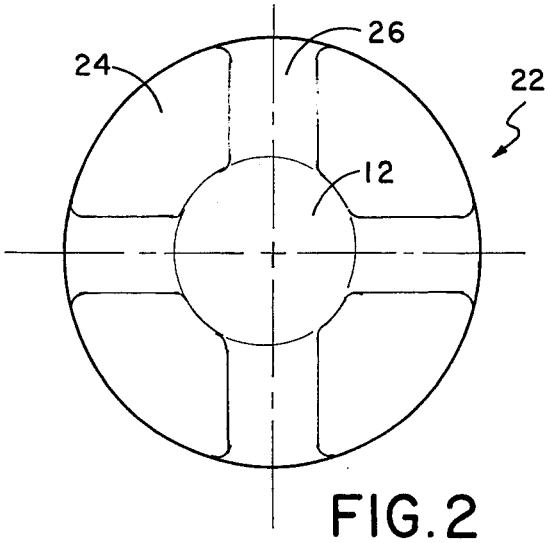
FIG. 2
FIG. 3
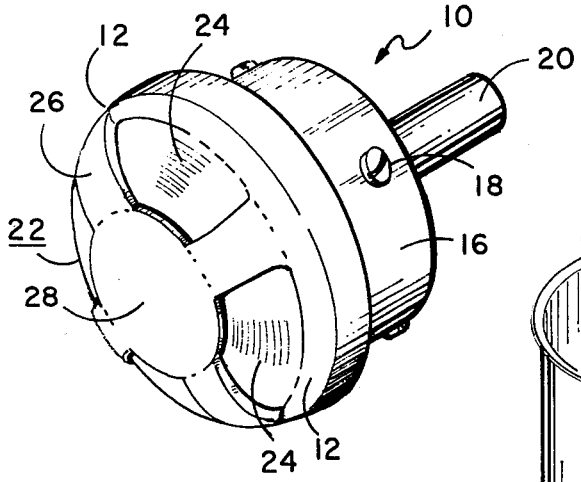
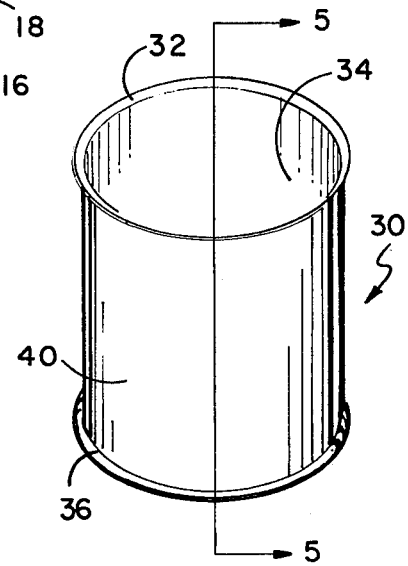
FIG. 4
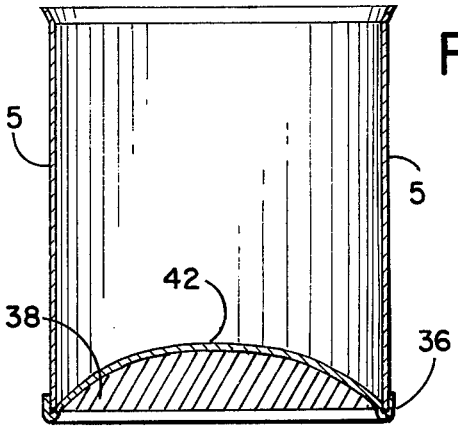
FIG. 5

PRODUCTION OIL CAN AND TOOL

BACKGROUND OF THE INVENTION

1. Field of the Invention

This invention pertains to production oil cans having weighted bases and flared edges for use in oiling machinery with brushes; and to a nylon tool attachment for a drill press used to stretch and deform the base of a tin can into a weighted production oil can.

2. Description of the Prior Art

In manufacturing plants, such as machine shops, sheet metal shops and the like, machinery is oiled by taking oil from an open can on a brush and applying the oil to a part of metal being worked on by a drill press, boring machine, or other tools. The common tin can currently in use upsets easily, resulting in spilling of oil. Upsets are caused by many factors, including a blast of air from an air hose on the machine. Such accidental upsets are difficult to avoid and disrupt production.

The oil can of the present invention is designed to facilitate production by providing a weighted base to resist upsetting, flared edges to clean excess oil from the brushes, and a height proportionate to the and also to resist upsetting. The weighted can of this invention is fabricated from ordinary tin cans by stretching and deforming the base of the tin can to create cavity space to contain and retain the weight added to the base of the can. The can is cut to a proportionate height and its edges flared. The tool used to stretch and deform the base of a tin can is an attachment to a drill press having an operative member of nylon. The nylon tool is applied to the base of a tin can and rotated slowly. The wrinkles in the base of a tin can provide sufficient metal for deformation without breaking and the nylon does not remove the tin plating. After the base is deformed, hot lead may be poured in the base cavity to add weight to the base. The lead will adhere to the tin and when cool will remain in place. Thus the tool enables an improved production oil can to be fabricated easily without additional tooling costs for a can mold.

The inventor has no present knowledge of any tool in use having an isomorphic configuration or similar function. The uniqueness of the tool, as distinguished from the prior art, is the configuration of the operative component and being made from nylon, which has unique properties when operated against a tin surface.

Although weighted containers, in themselves, are not unique, the tool affords an improved and simplified process to achieve the same. To the best knowledge of the inventor, drawing dies presently in use are unable to perform the function of this tool. There appears to be no prior art, including drawing dies, capable of producing the desired result as effectively as the invention herein discloses.

SUMMARY OF THE INVENTION

This invention relates to a production oil can, for use in oiling machinery, having a weighted base, flared upper edges and a proportionate height. The can is principally fabricatd from a standard tin can be stretching and deforming the base of a standard tin can to form a cavity therein, using the novel tool disclosed herein, inserting a weighted substance such as molten lead therein and securing the weighted substance in said cavity.

This invention relates also to a tool, particularly one which may be attached to a variable speed drill press, which provides a means by which a standard and common tin can may be recycled for use as an open-ended container of fluids, particularly a container which may be used as a production oil can. Such cans are commonly found in industry, especially in machine shops where lubricants and liquid solvents are frequently applied to mechanical components. The tool's application provides a quick, simple, and economic means for stretching and deforming the base of a tin can, so that the can may be weighted to lower the center of gravity, which, in turn, minimizes the chance of the inadvertent upsetting of the container and the resultant spillage of the fluid contained therein.

The tool itself is constructed from nylon. Combined with the design of the operative surface of the tool, the unique properties of the nylon, when in contact with a tin surface, produces a low friction, self-lubricating effect which, in turn, eliminates the necessity of using a lubricant in the process. The convex operative surface of the tool, said tool being a circular solid, is defined by four radial ribs which converge in the center of the operative surface forming the outermost vertex of said operative surface; thus four trapazoidally shaped depressed areas containing air are created.

The tool is mounted to a metallic cap which surrounds the neck and upper surface of the tool. The cap is secured to the tool by four screws positioned equidistantly around the circumference of the neck. A metallic shaft, designed to fit a drill chuck, is incorporated in to the cap.

The tool, when forced against a stationary tin surface, in a slowly rotating motion of sixty to seventy RPM, acts to stretch the tin surface into conformity with the convex shape of the operative surface of the tool without removing or impairing the tin surface. The normal wrinkles found in the base of a standard tin can provide sufficient metal to make this stretching possible. After forming a depression in the outer base surface of a tin can with the tool, a weighted material may be placed in the depression. This material is preferably molten lead because of the natural tendency of the lead to adhere to the tin surface and thus be secured without any fastening means. The molten lead, as all liquids, forms a natural concave surface because of the surface-tension effect. Thus, after the lead hardens and the weighted can is put to use, it can be placed on a wet, slippery surface and be virtually immovable during use, due to the slight vacuum effect created and due to its low center of gravity.

The use of a tin can as a container of lubricants or other fluids is quite common in industry, especially in machine shops of all types. A typical usage is when a brush is frequently used to apply oil to an exposed movable part which needs to be manually oiled at periodic intervals. Often the container is inadvertantly upset, for example, from a misguided squirt of air from an air hose, thus spilling the fluid. The aforementioned tool and process are unique and useful in that they afford a way to increase efficiency, by minimizing lost clean-up time, and to increase safety, by minimizing the chance of accidents created by spilled fluids. The weighted container may be produced in a relatively short period of time, and the materials are readily available in any machine shop.

The weight, when placed within the container, is undesirable in many instances, as the fluid may react with or be contaminated by the weight; this necessitates the need for the weight being placed on the underside of the can bottom. A standard tin can bottom, however, does not possess the needed space to attach an appropriate weight in a simple, efficient way; said needed space is provided through the use of the tool. The tool is an alternative to making a new drawing die with more depth capacity than those now in use. The simplicity of the tool and process make the aforementioned production oil can desireable over the variations discussed and other variations which may be in use today.

Two modifications of the weighted can may be made. One modification being, after forming the depression, a formed metal base is attached to the depressed can bottom. The bottom of the base has a ribbed edge upon which it rests. The upper surface is formed in the shape of the operative surface of the tool. A rivet or other attaching means is placed through the center of the can bottom and base.

Another modification of the can is achieved by deforming the can bottom with the tool, and attaching a formed metal base, said bottom of the metal base being designed as previously mentioned. The upper edge of the base is characterized by a groove with a protruding upper lip surrounding the perimeter of the base edge. The tip is fitted into the position where the can wall meets the can bottom. The bottom rim of the can is then clinched in a plurality of places to secure the base. No rivet is required.

To further increase the utility of the container, a fold-over hem and flair are formed at the open end of the can to provide structural stiffness which is needed to retain the cylindrical shape of the can. Thus a long lasting container, which resists upsetting and greatly reduces the possibility of spilling fluids, is produced by the use of the tool. The tool affords a simple and economic means for improving the utility and efficiency of a production fluid container, the problems of which have heretofore been inadequately solved.

BRIEF DESCRIPTION OF THE DRAWINGS

FIG. 1 is a perspective side view illustrating the tool as it would be seen in an operative position.

FIG. 2 is a bottom view of the operative surface of the tool of FIG. 1.

FIG. 3 is a perspective view illustrating the convex nature of the operative surface of the tool of FIGS. 1 and 2.

FIG. 4 is a perspective view of the weighted production oil can illustrating the flanged top rim of the can.

FIG. 5 is a cross-sectional view of the preferred embodiment of the weighted base of the production oil can taken along the line 5—5 of FIG. 4.

DESCRIPTION OF THE DRAWINGS

Referring to FIGS. 1, 2, and 3 and referring primarily to FIG. 3, the preferred embodiment of tool 10 of this invention is illustrated.

As best illustrated in FIG. 1, disc-shaped operative nylon component 12 is surrounded and secured at its neck 14 within metallic cap 16. Four screws 18 spaced equidistantly around the circumference of cap 16 secure aforementioned components 14, 16. Metallic shaft 20, designed to fit into a drill press chuck, is integrated into cap 16.

FIG. 3 best illustrates convex operative surface 22 of tool 10. Trapezoidially-shaped depressed areas 24 are defined by four radial ribs 26 which converge to also define circular raised area 28 being the outer-most portion of convex operative surface 22.

When tool 10 is properly installed in drill press, rotated at sixty to seventy RPM and pressed against the base of a standard tin can, tool 10 will gradually stretch and deform the base of can 30 to form a cavity having an upper surface such as base 42 of FIG. 5. The cavity in the base of can 30 thus provides room for the insertion or attachment of a weighted material, as shown in FIGS. 5 and 6.

Tool 10, when forced against the stationary tin surface such as the base of can 30 in a slow rotary motion, acts to stretch and deform the base of can 30 to conform to its operative surface 22. The rotary motion of nylon operative surface 22 against the tin surface of the base of can 30 results in a self-lubricating operation and the air in depressed areas 24 decreases the frictional heat normally present.

Referring to FIG. 4 a set up view of weighted can 30 is illustrated. Structural flanged rib flare 32 is positioned at open end 34 of can 30. Clinched bottom flare 36, slightly reformed by tool 10, is positioned where weighted can bottom 38 is secured to side wall 40 as in most cans.

Referring to FIG. 5 of the preferred embodiment, wherein the configuration of weighted bottom 38 of can 30 is shown in cross-sectional view along line 5—5 of FIG. 4, original can bottom 42 is illustrated after having been formed by tool 10. Lead weighted base 38 is shown in its position after adhering to tin bottom surface 42. Clinched bottom flare 36 is also illustrated.

I claim:

1. An open ended, weighted tin container for fluids comprising:

a side wall;

a flanged rib flare positioned at said open end of said container on said side wall;

a bottom having an inward concave depression;

a flare extending around side walls and bottom;

a weight secured within said depression;

said weight being incorporated and secured therein by pouring molten lead into said depression and allowing said lead to harden;

said lead adhering to said tin surface due to physical and chemical binding interaction of molten led and tin;

thereby forming a curved bottom surface due to surface tension effect.

* * * * *